US008393940B2

(12) United States Patent
Swedek et al.

(10) Patent No.: US 8,393,940 B2
(45) Date of Patent: Mar. 12, 2013

(54) MOLDING WINDOWS IN THIN PADS

(75) Inventors: Boguslaw A Swedek, Cupertino, CA (US); Doyle E Bennett, Santa Clara, CA (US); Dominic J Benvegnu, La Honda, CA (US)

(73) Assignee: Applied Materials, Inc., Santa Clara, CA (US)

( * ) Notice: Subject to any disclaimer, the term of this patent is extended or adjusted under 35 U.S.C. 154(b) by 403 days.

(21) Appl. No.: 12/762,175

(22) Filed: Apr. 16, 2010

(65) Prior Publication Data

US 2011/0256818 A1 Oct. 20, 2011

(51) Int. Cl.
*B24D 11/00* (2006.01)

(52) U.S. Cl. ..... 451/527; 451/6; 451/548; 51/298; 264/263

(58) Field of Classification Search ..... 451/6, 41, 451/527, 548; 51/298; 264/263
See application file for complete search history.

(56) References Cited

U.S. PATENT DOCUMENTS

| | | | | |
|---|---|---|---|---|
| 5,738,574 | A | 4/1998 | Tolles et al. | |
| 6,358,130 | B1 * | 3/2002 | Freeman et al. | 451/285 |
| 6,685,537 | B1 | 2/2004 | Fruitman et al. | |
| 6,855,034 | B2 | 2/2005 | Hasegawa | |
| 6,994,607 | B2 * | 2/2006 | Wiswesser | 451/5 |
| 7,179,151 | B1 * | 2/2007 | Bottema et al. | 451/6 |
| 7,841,926 | B2 * | 11/2010 | Birang et al. | 451/6 |
| 2003/0190867 | A1 * | 10/2003 | Birang et al. | 451/6 |
| 2004/0033758 | A1 * | 2/2004 | Wiswesser | 451/6 |
| 2005/0191945 | A1 * | 9/2005 | Petroski et al. | 451/6 |
| 2006/0128271 | A1 * | 6/2006 | Shiho et al. | 451/6 |
| 2006/0252358 | A1 * | 11/2006 | Preston et al. | 451/548 |
| 2008/0305729 | A1 | 12/2008 | Benvegnu et al. | |

FOREIGN PATENT DOCUMENTS

JP 2007-044814 2/2007

OTHER PUBLICATIONS

International search report and written opinion dated Dec. 23, 20111 for corresponding application No. PCT/US2011/029468.

* cited by examiner

*Primary Examiner* — George Nguyen
(74) *Attorney, Agent, or Firm* — Fish & Richardson P.C.

(57) ABSTRACT

A polishing pad includes a polishing layer having a polishing surface, an adhesive layer on a side of the polishing layer opposite the polishing layer, and a solid light-transmitting window extending through and molded to the polishing layer. The solid light-transmitting window has an upper portion with a first lateral dimension and a lower portion with a second lateral dimension that is smaller than the first lateral dimension. A top surface of the solid light-transmitting window coplanar with the polishing surface and a bottom surface of the solid light-transmitting window coplanar with a lower surface of the adhesive layer.

13 Claims, 3 Drawing Sheets

MOLDING WINDOWS IN THIN PADS

TECHNICAL FIELD

A polishing pad with a window, a system containing such a polishing pad, and a process for making and using such a polishing pad are described.

BACKGROUND

In the process of fabricating modern semiconductor integrated circuits (IC), it is often necessary planarize the outer surface of the substrate. For example, planarization may be needed to polish away a conductive filler layer until the top surface of an underlying layer is exposed, leaving the conductive material between the raised pattern of the insulative layer to form vias, plugs and lines that provide conductive paths between thin film circuits on the substrate. In addition, planarization may be needed to flatten and thin an oxide layer to provide a flat surface suitable for photolithography.

One method for achieving semiconductor substrate planarization or topography removal is chemical mechanical polishing (CMP). A conventional chemical mechanical polishing (CMP) process involves pressing a substrate against a rotating polishing pad in the presence of an abrasive slurry.

In general, there is a need to detect when the desired surface planarity or layer thickness has been reached or when an underlying layer has been exposed in order to determine whether to stop polishing. Several techniques have been developed for the in-situ detection of endpoints during the CMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad.

SUMMARY

In one aspect, a polishing pad includes a polishing layer having a polishing surface, an adhesive layer on a side of the polishing layer opposite the polishing surface, and a solid light-transmitting window extending through and molded to the polishing layer. The solid light-transmitting window has an upper portion with a first lateral dimension and a lower portion with a second lateral dimension that is smaller than the first lateral dimension. A top surface of the solid light-transmitting window coplanar with the polishing surface and a bottom surface of the solid light-transmitting window coplanar with a lower surface of the adhesive layer.

Implementations can include one or more of the following features. The polishing layer may consists of a single layer. A removable liner may span the adhesive layer. The upper portion may projects laterally beyond the lower portion on all sides of the window. The upper portion may have a lateral dimension two to four times as large as a lateral dimension of the lower portion. The lower portion may be positioned at a center of the upper portion. The window may be circular and the upper portion and lower portion may be concentric. The upper portion may have a diameter of about 6 mm, and the lower portion may have a diameter of about 3 mm. Grooves may be in the polishing surface. The polishing pad may have a total thickness less than 1 mm.

In another aspect, a method of making a polishing pad includes a forming a recess in a polishing layer, the recess extending partially but not entirely through the polishing layer, forming a hole through the polishing layer and an adhesive layer, the hole positioned in the recess and having a first lateral dimension that is smaller than a second lateral dimension of the recess, the combination of the recess and the hole providing an aperture through the polishing layer and adhesive layer, securing a sealing film to the adhesive layer on a side opposite a polishing surface of the polishing layer to span the hole, dispensing a liquid polymer into the aperture, and curing the liquid polymer to form a window.

Implementations can include one or more of the following features. The adhesive layer may be covered with a liner prior to forming the recess, the liner may be pealed back to secure the sealing film to the adhesive layer, and the adhesive layer may be recovered with the liner after the liquid polymer has cured. A portion of cured polymer projecting above the polishing surface may be removed. The polishing layer may consist of a single layer. Forming the recess may include embossing the polishing pad. Embossing the polishing pad may include pressing on the polishing pad with a heated metal piece. Forming the hole may includes punching through the polishing layer and the adhesive layer. The upper portion may project laterally beyond the lower portion on all sides of the window. The upper portion may have a lateral dimension 1.5 to 4 times, e.g., 2 times, as large as a lateral dimension of the lower portion. The lower portion may be positioned at a center of the upper portion. The window may be circular and the upper portion and lower portion may be concentric. The polishing pad may have a total thickness less than 1 mm.

Implementations may include the following potential advantages. A strong bond can be formed between the window and a thin polishing pad, reducing the likelihood of slurry leakage and reducing the likelihood of the window being pulled from the pad due to shear force from the substrate being polished. In addition, the polishing pad can improve wafer-to-wafer uniformity of spectrum reflected from the substrate, particularly at short wavelengths.

The details of one or more embodiments are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

Figure 1:
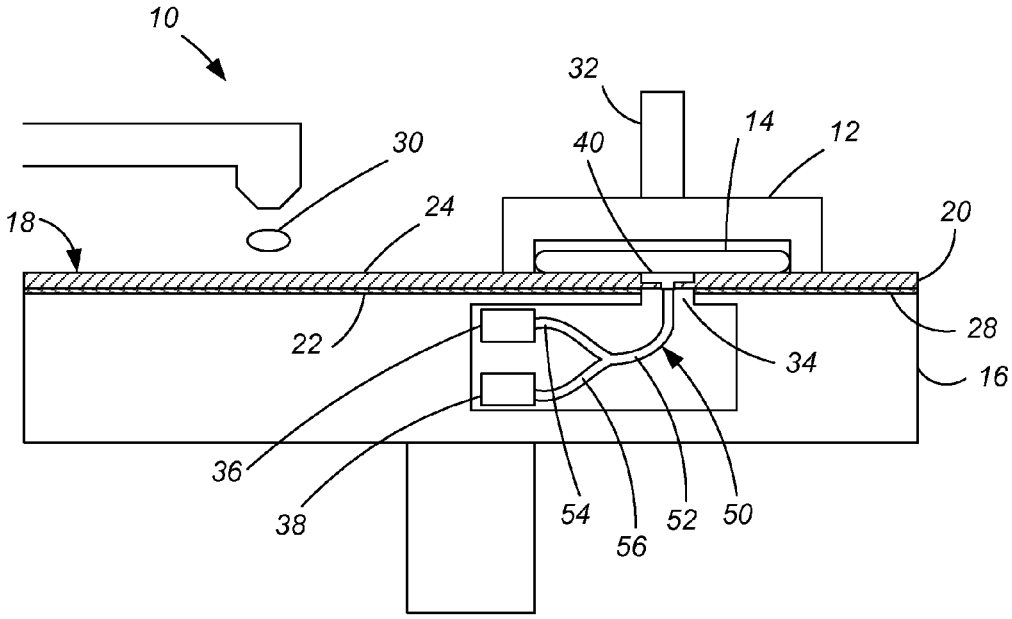
FIG. 1 is a cross-sectional view of a CMP apparatus containing a polishing pad.

As shown in FIG. 1, the CMP apparatus 10 includes a polishing head 12 for holding a semiconductor substrate 14 against a polishing pad 18 on a platen 16. The CMP apparatus may be constructed as described in U.S. Pat. No. 5,738,574, the entire disclosure of which is incorporated herein by reference.

The substrate can be, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The effective portion of the polishing pad 18 can include a polishing layer 20 with a polishing surface 24 to contact the substrate and a bottom surface 22 to secured to the platen 16 by an adhesive layer 28, e.g., an adhesive tape. Other than the adhesive tape and any liner, the polishing pad can be, e.g., consist of, a single-layer pad, with the polishing layer 20 formed of a thin durable material suitable for a chemical mechanical polishing process. Thus, the layers of the polishing pad can consist of the single-layer polishing layer 20 and the adhesive layer 28 (and optionally a liner, which would be removed when the pad is installed on the polishing platen).

The polishing layer 20 can be, e.g., consist of, a foamed polyurethane, with at least some open pores on the polishing surface 24. The adhesive layer 28 can be a double-sided adhesive tape, e.g., a thin layer of polyethylene terephthalate (PET), e.g., Mylar®, with adhesive, e.g., pressure-sensitive adhesive, on both sides. Such a polishing pad is available under the trade name H7000HN from Fujibo in Tokyo, Japan.

Figure 2:
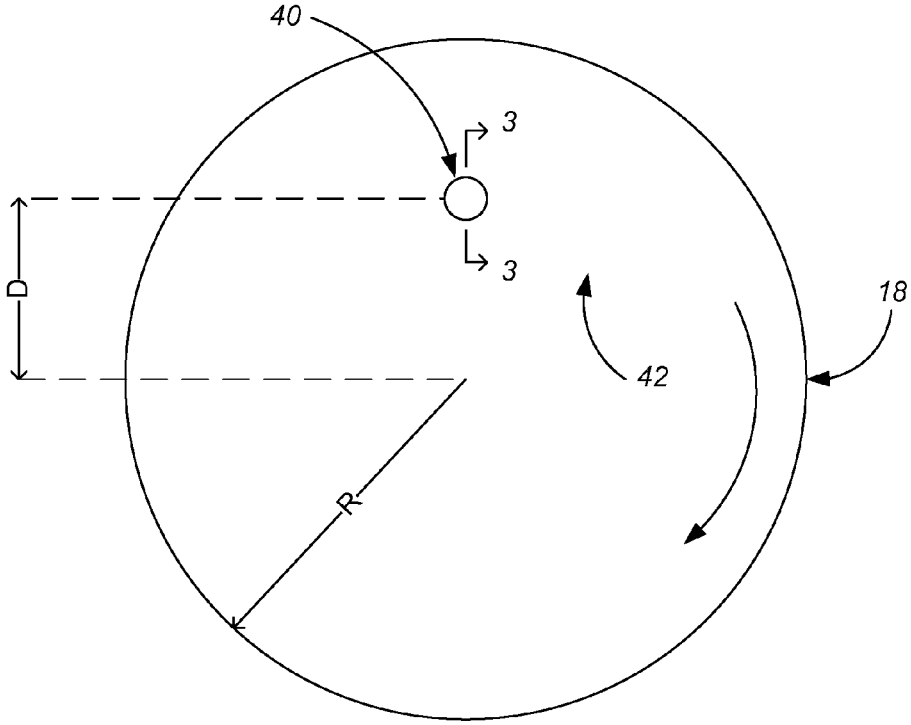
FIG. 2 is a top view of an embodiment of a polishing pad with a window.

Referring to FIG. 2, in some implementations the polishing pad 18 has a radius R of 15.0 (381.00 mm) to 15.5 inches (393.70 mm), with a corresponding diameter of 30 to 31 inches. In some implementations, the polishing pad 18 can have a radius of 21.0 (533.4 mm) to 21.5 inches (546.1 mm), with corresponding diameter of 42 to 43 inches.

Figure 3:
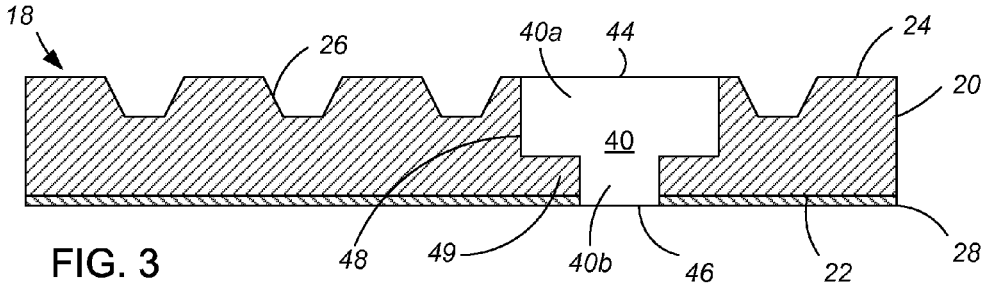
FIG. 3 is a cross-sectional view of the polishing pad of FIG. 2.

Referring to FIG. 3, in some implementations, grooves 26 can be formed in the polishing surface 24. The grooves can be in a "waffle" pattern, e.g., a cross-hatched pattern of perpendicular grooves with sloped side walls that divide the polishing surface into rectangular, e.g., square, areas.

Returning to FIG. 1, typically the polishing pad material is wetted with the chemical polishing liquid 30, which can include abrasive particles. For example, the slurry can include KOH (potassium hydroxide) and fumed-silica particles. However, some polishing processes are "abrasive-free".

The polishing head 12 applies pressure to the substrate 14 against the polishing pad 18 as the platen rotates about its central axis. In addition, the polishing head 12 is usually rotated about its central axis, and translated across the surface of the platen 16 via a drive shaft or translation arm 32. The pressure and relative motion between the substrate and the polishing surface, in conjunction with the polishing solution, result in polishing of the substrate.

An optical aperture 34 is formed in the top surface of the platen 16. An optical monitoring system, including a light source 36, such as a laser, and a detector 38, such as a photodetector, can be located below the top surface of the platen 16. For example, the optical monitoring system can be located in a chamber inside the platen 16 that is in optical communication with the optical aperture 34, and can rotate with the platen. One or more optical fibers 50 can carry light from the light source 36 to the substrate, and from the substrate to the detector 38. For example, the optical fiber 50 can be a bifurcated optical fiber, with a trunk 52 in proximity, e.g., abutting, the window 40 in the polishing pad, a first leg 54 connected to the light source 36, and a second leg 56 connected to the detector 38.

The optical aperture 34 can be filled with a transparent solid piece, such as a quartz block (in which case the fiber would not abut the window 40 but could abut the solid piece in the optical aperture), or it can be an empty hole. In one implementation, the optical monitoring system and optical aperture are formed as part of a module that fits into a corresponding recess in the platen. Alternatively, the optical monitoring system could be a stationary system located below the platen, and the optical aperture could extend through the platen. The light source 36 can employ a wavelength anywhere from the far infrared to ultraviolet, such as red light, although a broadband spectrum, e.g., white light, can also be used, and the detector 38 can be a spectrometer.

A window 40 is formed in the overlying polishing pad 18 and aligned with the optical aperture 34 in the platen. The window 40 and aperture 34 can be positioned such that they have a view of the substrate 14 held by the polishing head 12 during at least a portion of the platen's rotation, regardless of the translational position of the head 12. The light source 36 projects a light beam through the aperture 34 and the window 40 to impinge the surface of the overlying substrate 14 at least during a time when the window 40 is adjacent the substrate 14. Light reflected from the substrate forms a resultant beam that is detected by the detector 38. The light source and the detector are coupled to an unillustrated computer that receives the measured light intensity from the detector and uses it to determine the polishing endpoint, e.g., by detecting a sudden change in the reflectivity of the substrate that indicates the exposure of a new layer, by calculating the thickness removed from of the outer layer (such as a transparent oxide layer) using interferometric principles, by monitoring the spectrum of the reflected light and detecting a target spectrum, by matching a sequence of measured spectra to reference spectra from a library and determining where a linear function fit to index values of the reference spectrum reaches a target value, or by otherwise monitoring the signal for predetermined endpoint criteria.

One problem with placement of a normal large rectangular window (e.g., a 2.25 by 0.75 inch window) into a very thin polishing layer is delamination during polishing. In particular, the lateral frictional force from the substrate during polishing can be greater than the adhesive force of the molding of the window to the sidewall of the pad.

Returning to FIG. 2, the window 40 can be small, e.g., less than 10 mm in diameter, e.g., so as to reduce the frictional force applied by the substrate during polishing. For example, the upper portion of the window 40 can be a circular area about 6 mm wide centered a distance D of about 7.5 inches (190.50 mm) from the center of a 30 to 31 inch diameter polishing pad 18, or centered a distance D of about 9 to 11 inches from the center of a 42 to 43 inch diameter polishing pad 42.

The window 40 can have an approximately circular shape (other shapes are possible, such as rectangular). If the window is elongated, its longer dimension can be substantially parallel to the radius of the polishing pad that passes through the center of the window. The window 40 can have a ragged perimeter 42, e.g., the perimeter can be longer than a perimeter of a similarly shaped circle or rectangle. This increases the surface area for contact of the window to the sidewall of the polishing pad, and can thereby improve adhesion of the window to the polishing pad.

Referring to FIG. 3, the window 40 includes an upper portion 40*a* and a lower portion 40*b*. The window 40, including the upper portion 40*a* and lower portion 40*b*, can be a unitary single-piece body of homogeneous material. The lower portion 40*b* is vertically aligned with the upper portion 40*a* but is laterally smaller (i.e., in the direction parallel to the polishing surface) than the upper portion 40*a*. Thus, a portion, of the polishing layer 20 projects below upper portion 40*a* so that the rim of the upper portion 40*b* that projects beyond the lower portion 40*a* is supported on a ledge 49 of the polishing material of the polishing layer. The upper portion 40*a* can project laterally beyond the lower portion 40*b* on all sides of the window 40, or optionally the upper portion 40*a* can project laterally beyond the lower portion 40*b* on two opposing sides of the window 40 but be aligned along other sides of the window 40. The bottom surface of the upper portion 40*a* that projects beyond the lower portion 40*b* can be a substantially planar surface. The lower portion 40*b* can be located in the center of, e.g., be concentric with, the upper portion 40*a*. The upper portion 40*a* can have a lateral dimension 1.5 to 4 times, e.g., 2 times, as large as the lateral dimension of the lower portion 40*b*. For example, if the window 40 is circular, the upper portion 40*a* can have a diameter of 6 mm, and the lower portion 40*b* can have a diameter of 3 mm.

The upper portion 40*a* can be about the same thickness as the lower portion 40*b*. Alternatively, the upper portion 40*a* can be thicker than, or be thinner than, the lower portion 40*b*.

The lower portion 40*b* of the window 40 can project into an aperture in the adhesive layer 28. The edge of the adhesive layer 28, e.g., adhesive tape, can abut the sides of the lower portion 40*b* of the window 40.

The window is as thick as the combination of the polishing layer 20 and the adhesive layer 28. The top surface 44 of the window 40 is coplanar with the polishing surface 24 and a bottom surface 46 of the window is coplanar with a bottom surface of the adhesive layer 28.

The perimeter of the window 40 can be secured, e.g., molded, to the inner sidewall edges 48 of the polishing layer 20, and the bottom surface of the upper portion 40*a* can be secured, e.g., molded, to the upper surface of the ledge 49 of the polishing material of the polishing layer 20 that projects below the upper portion 40*a*. The increased surface area of connection between the window 40 and the polishing layer provided by the connection on the ledge 49 can provide a stronger bond, reducing the likelihood of slurry leakage and reducing the likelihood of the window being pulled from the pad due to shear force from the substrate being polished.

Figure 4:
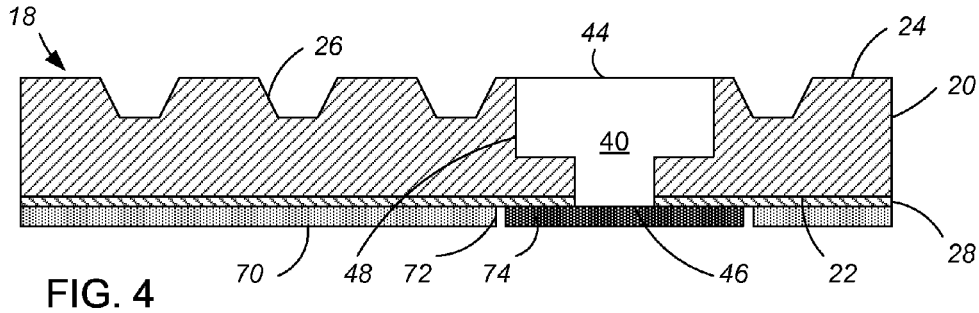
FIG. 4 is a cross-sectional view of the polishing pad of FIG. 2 with a liner.

Referring to FIG. 4, before installation on a platen, the polishing pad 18 can also include a liner 70 that spans the adhesive layer 28 on the bottom surface 22 of the polishing pad. The liner can be an incompressible and generally fluid-impermeable layer, for example, polyethylene terephthalate (PET), e.g., Mylar™. In use, the liner is manually peeled from the polishing pad, and the polishing layer 20 is applied to the platen with the adhesive layer 28. The liner, however, does not span the window 40, but is removed in and immediately around the region of the lower portion 40*b* of the window 40, e.g., in a region about 1 to 4 cm across, to form a hole 72.

The polishing pad 40 is very thin, e.g., less than 2 mm, e.g., less than 1 mm. For example, the total thickness of the polishing layer 20, adhesive 28 and liner 70 can be about 0.8 or 0.9 mm. The polishing layer 20 can be about 0.7 or 0.8 mm thick, with the adhesive 28 and the liner 70 providing about another 0.1 mm. The grooves 26 can be about half the depth of the polishing pad, e.g., roughly 0.5 mm.

In addition to the liner 70, an optional window backing piece 74 can be placed in the hole 72 to span the window 40 and be secured to a portion of the adhesive layer 28 immediately around the window 40. The backing piece 72 can be the same thickness as the liner 70, or thinner than the liner 70. The backing piece 72 can be polytetrafluoroethylene (PTFE), e.g., Teflon®, or another non-stick material.

Figure 5:
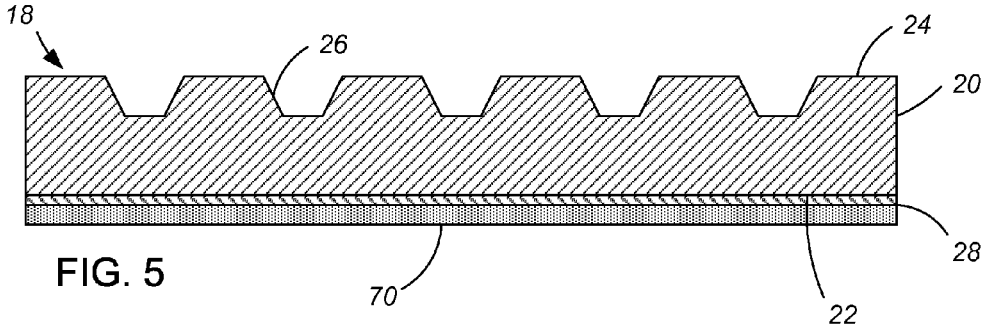
FIGS. 5-10 illustrate a method of forming a polishing pad.

To manufacture the polishing pad, initially the polishing layer 20 is formed and the bottom surface of the polishing layer 20 is covered with the pressure sensitive adhesive 28 and a liner layer 70, as shown by FIG. 5. Grooves 26 can be formed in the polishing layer 20 as part of a pad molding process before attachment of the pressure sensitive adhesive 28 and a liner layer 70, or cut into the polishing layer 20 after the pad is formed and after the liner is attached.

Figure 6:
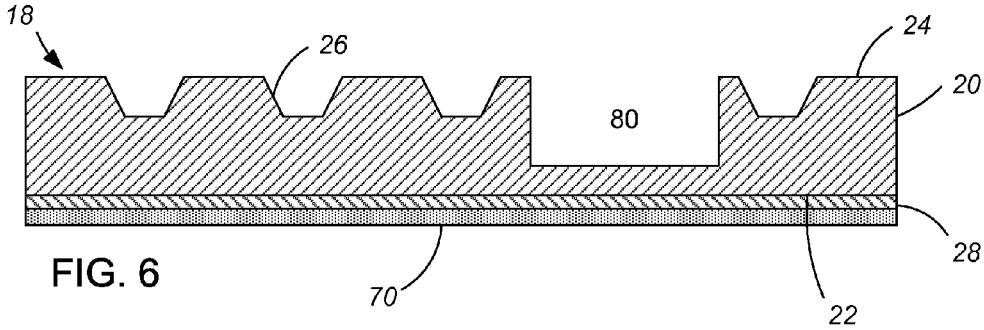

As shown by FIG. 6, a recess 80 is embossed into the polishing surface 24 of the polishing layer 20. As shown, the recess 80 extends partially but not entirely through the polishing layer 20. The recess 80 can overlap one or more of the grooves 26. The recess 80 can be embossed by heating a metal part, e.g., an iron, steel, or aluminum piece, of the same size as the desired upper portion 40*a* of the window. The metal part can be heated to a temperature around 375° to 425° F. Such a heating element can be constructed by simply attaching a metal part of the desired shape to a conventional soldering iron. The hot metal part is then pressed into the top surface of the polishing layer 20, melting and compressing the polishing layer 20 in the embossed region, thereby forming the recess 80. The compression and heating also tends to collapse the pores to create a more compressed and lower porosity material.

Figure 7:
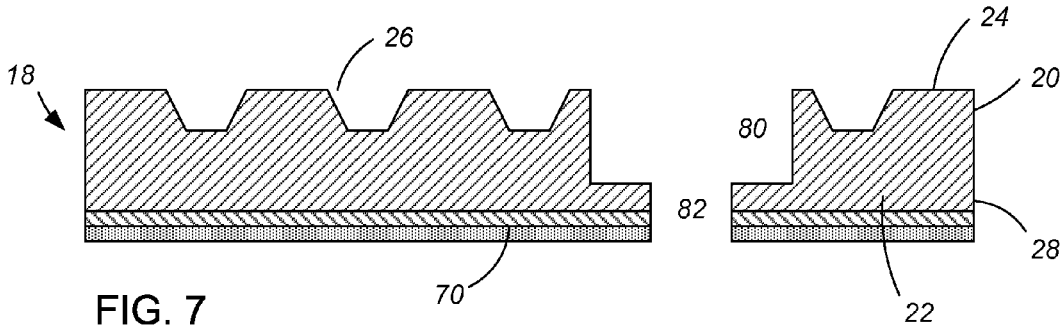

As shown by FIG. 7, after the recess 80 has been formed in the top surface, a hole 82 is punched through the entire pad, including the polishing layer 20, the adhesive 28 and the liner 70. The hole 82 is punched in the bottom of the recess 80, and has a smaller lateral dimension than the recess 80. The hole 82 will provide the lower portion 40*b* of the window 40. The hole 82 can be punched from the top (i.e., the side with the polishing surface) of the pad, e.g., by a machine press. This permits the position of the hole 82 to be more accurately aligned with the recess 80.

Figure 8:
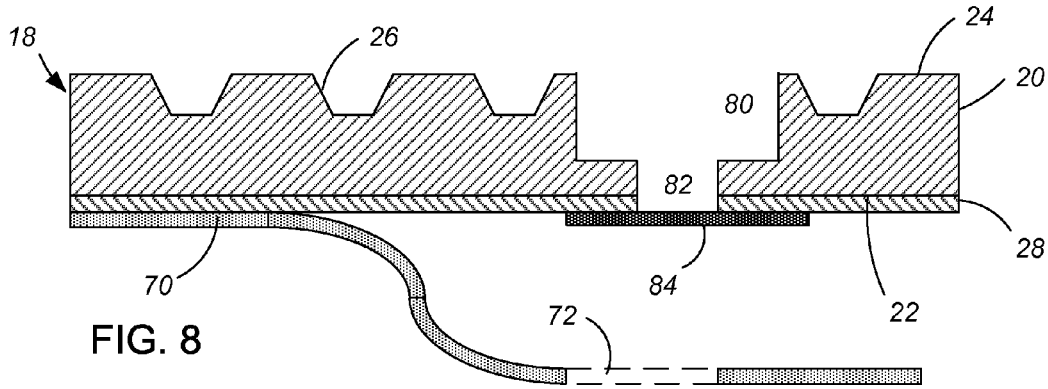

A portion of the liner 70 is peeled away from the adhesive layer 28, as shown in FIG. 8. The liner 70 need not be peeled of the polishing pad entirely. The portion of the liner that is peeled away exposes the bottom surface of the adhesive layer 28 around the hole 82. The aperture 72 can be cut in liner 70, e.g., in a region surrounding the hole that was punched through the liner 70, although this step can be performed at a later time.

In addition, a non-stick sealing film 84 is attached to the adhesive layer 28 to span the hole 82. The sealing film can be a polytetrafluoroethylene (PTFE) film, e.g., Teflon®. The sealing film 84 will serve as the bottom of the mold for the window. The sealing film can be cleaned, e.g., wiped with ethanol.

Figure 9:
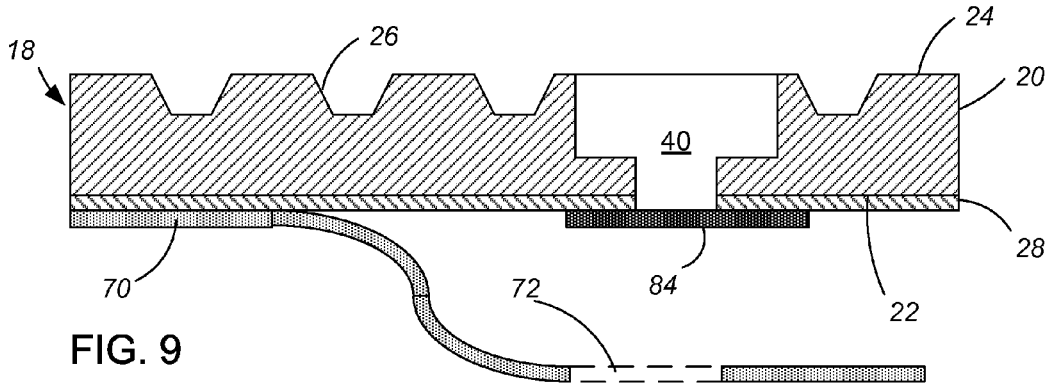

A liquid polymer is prepared and transferred into the aperture 80 and hole 82, and then cured to form the window 40, as shown in FIG. 9. The polymer can be polyurethane, and can be formed from a mixture of several components. In one implementation, the polymer is a mixture of 2 parts Calthane A 2300 and 3 parts Calthane B 2300 (available from Cal Polymers, Inc. of Long Beach, Calif.). The liquid polymer mixture can be degassed, e.g., for 15-30 minutes, before being placed into the aperture. The polymer can be cured at room temperature for about 24 hours, or a heat lamp or oven can be used to decrease cure time. If the cured window 40 initially projects above the polishing surface then the window can be leveled to be coplanar with the polishing surface, e.g., by abrasion with a diamond conditioning disk.

Figure 10:
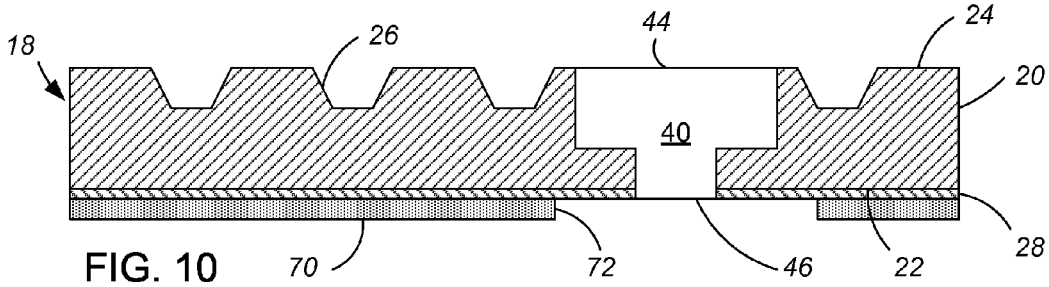

Referring to FIG. 10, the sealing film 84 can be removed from the bottom surface of the adhesive layer 28 after the cure of the window 40 is complete. This leaves the bottom surface of the window 40 coplanar with the bottom surface of the adhesive layer 28.

Next the liner 70 can be replaced on the adhesive layer 28, with the aperture 72 in the liner 70 surrounding the bottom portion 40*b* of the window 40. Optionally, the window backing piece 74 can be placed in the hole 72 the liner. The polishing pad should then be read for shipment to the customer, e.g., in a sealed plastic bag. As discussed above, when the customer receives the pad, the customer can remove the liner 70 (and window backing piece if present), and then attach the polishing pad on the platen using the adhesive layer 28.

If the grooves 24 intersect the aperture 80, then when the liquid polymer is transferred into the aperture, a portion of the liquid polymer can flow along the grooves 24. Thus, some of the polymer can extend past the edge of the aperture 80 to form projections into the grooves. When cured, these projections further increase the bonding of the window to the polishing pad. In addition, if sufficient liquid polymer is provided, then some of the liquid polymer can flow over the top surface of the polishing layer. Again, when cured, the portion of the polymer over the polishing surface can increase the bonding of the window to the polishing pad, although as discussed above the portion of the window 40 projecting above the polishing surface can be removed so that the top of the window is flush with the polishing surface.

In another implementation, a top surface 44 of the window 40 can be coplanar with the polishing surface 24, and a bottom surface 46 of the window can be coplanar with a bottom surface of the polishing layer 20. In this case, the window can be as deep as the polishing layer 20. For this alternative, the fabrication process would be modified by removing a portion of the adhesive layer around the lower portion 40*b*, placing a sealing film directly against the bottom of the polishing layer, filling the aperture with the liquid polymer and curing to form the window, and then removing the sealing film.

While certain embodiments have been described, the invention is not so limited. For example, although a window with a simple circular shape is described, the window could be more complex, such as a rectangle, oval or star. The top portion of the window can project past one or more sides of the bottom portion. It will be understood that various other modifications may be made without departing from the spirit and scope of the invention. Accordingly, other embodiments are within the scope of the following claims.

What is claimed is:

1. A method of making a polishing pad, comprising:

pressing and applying heat to a surface of a polishing layer to make a recess in the polishing layer, the recess extending partially but not entirely through the polishing layer, the recess having a first lateral dimension;

forming a hole through the polishing layer and an adhesive layer, the hole positioned in the recess and having a second lateral dimension that is smaller than the first lateral dimension of the recess, the combination of the recess and the hole providing an aperture through the polishing layer and adhesive layer;

securing a sealing film to the adhesive layer on a side opposite the surface of the polishing layer to span the hole;

dispensing a liquid polymer into the aperture; and curing the liquid polymer to form a window.

2. The method of claim 1, further comprising covering the adhesive layer with a liner prior to forming the recess, peeling back the liner to secure the sealing film to the adhesive layer, and recovering the adhesive layer with the liner after the liquid polymer has cured.

3. The method of claim 1, further comprising removing a portion of cured polymer projecting above the surface.

4. The method of claim 1, wherein the polishing layer consists of a single layer.

5. The method of claim 1, wherein pressing and applying heat to the surface of the polishing pad includes pressing on the polishing pad with a heated metal piece.

6. The method of claim 1, wherein forming the hole includes punching through the polishing layer and the adhesive layer from a polishing surface side of the polishing layer.

7. The method of claim 1, wherein the window includes an upper portion in the recess and a lower portion in the hole and the upper portion projects laterally beyond the lower portion on all sides of the window.

8. The method of claim 7, wherein the upper portion has a lateral dimension two to four times as large as a lateral dimension of the lower portion.

9. The method of claim 1 wherein the polishing pad has a total thickness less than 1 mm.

10. The method of claim 7, wherein the lower portion is positioned at a center of the upper portion.

11. The method of claim 10, wherein the window is circular and the upper portion and lower portion are concentric.

12. The method of claim 11, wherein, the upper portion has a diameter of about 6 mm, and the lower portion has a diameter of about 3 mm.

13. The method of claim 1, further comprising forming grooves in the polishing surface.

* * * * *